US008646881B1

(12) United States Patent
Dolan et al.

(10) Patent No.: US 8,646,881 B1
(45) Date of Patent: Feb. 11, 2014

(54) INTERSTITIAL MATERIAL TO ENABLE ROBUST ELECTRICAL INTERCONNECT FOR HIGH DENSITY PIEZOELECTRIC ARRAYS

(75) Inventors: Bryan R. Dolan, Rochester, NY (US); Gary D. Redding, Victor, NY (US); Peter J. Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/570,056

(22) Filed: Aug. 8, 2012

(51) Int. Cl.
*B41J 2/045* (2006.01)

(52) U.S. Cl.
USPC ..... 347/71; 347/68; 347/72; 347/70

(58) Field of Classification Search
USPC ..... 347/68–72
See application file for complete search history.

(56) References Cited

U.S. PATENT DOCUMENTS

2011/0141204 A1 6/2011 Dolan et al.

OTHER PUBLICATIONS

Redding et al., "Process for Adding Thermoset Layer to Piezoelectric Printhead," U.S. Appl. No. 13/279,778, filed Oct. 24, 2011.
Cellura et al., "Use of Photoresist Material as an Interstitial Fill for PZT Printhead Fabrication," U.S. Appl. No. 13/069,732, filed Mar. 23, 2011.
Nystrom et al., "High Density Electrical Interconnect for Printing Devices Using Flex Circuits and Dielectric Underfill," U.S. Appl. No. 13/097,182, filed Apr. 29, 2011.
Redding et al., "Polymer Film as an Interstitial Fill for PZT Printhead Fabrication," U.S. Appl. No. 13/323,867, filed Dec. 13, 2011.
Dolan et al., "Method for Interstitial Polymer Planarization Using a Flexible Flat Plate," U.S. Appl. No. 13/165,785, filed Jun. 21, 2011.

*Primary Examiner* — Henok Legesse
(74) *Attorney, Agent, or Firm* — MH2 Technology Law Group LLP

(57) ABSTRACT

An ink jet print head including a plurality of standoff layer supports in an interstitial region between adjacent piezoelectric elements, and method of formation. The plurality of standoff layer supports can be formed from the same layer(s) as the piezoelectric elements, or from a dielectric layer such as a polymer. The standoff layer supports increase an area to which a standoff layer can be attached, thereby forming a more secure attachment of a circuit layer such as a flex circuit or a printed circuit board to a jet stack subassembly.

14 Claims, 9 Drawing Sheets

INTERSTITIAL MATERIAL TO ENABLE ROBUST ELECTRICAL INTERCONNECT FOR HIGH DENSITY PIEZOELECTRIC ARRAYS

FIELD OF THE EMBODIMENTS

The present teachings relate to the field of ink jet printing devices and, more particularly, to methods and structures for high density piezoelectric ink jet print heads and a printer including a high density piezoelectric ink jet print head.

BACKGROUND OF THE EMBODIMENTS

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored, for example because they can use a wider variety of inks.

Piezoelectric ink jet print heads include an array of piezoelectric elements (i.e., transducers or PZTs). One process to form the array can include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet print heads can typically further include a flexible diaphragm to which the array of piezoelectric elements is attached. When a voltage is applied to a piezoelectric element, typically through electrical connection with an electrode electrically coupled to a power source, the piezoelectric element bends or deflects, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. One way to increase the jet density is to increase the density of the piezoelectric elements.

To attach an array of piezoelectric elements to pads or electrodes of a flexible printed circuit (flex circuit) or to a printed circuit board (PCB), a quantity (e.g., a microdrop) of conductor such as conductive epoxy, conductive paste, or another conductive material is dispensed individually on the top of each piezoelectric element. Electrodes of the flex circuit or PCB are placed in contact with each microdrop to facilitate electrical communication between each piezoelectric element and the electrodes of the flex circuit or PCB.

Achieving reliable electrical connections or interconnects between piezoelectric elements and a circuit layer becomes more challenging at increasing print head resolutions. Design constraints that require dimensionally smaller PZTs reduce both the surface area available for forming an electrical interconnect as well as the area for its surrounding bond adhesive. For example, openings within a standoff layer for an electrical connection between the circuit layer and PZT can be decreased by more than 60% across an array having 600 dots per inch (dpi) compared to an array having 300 dpi. Similarly, an effective bonding area can be reduced by more than 40% across an array having 600 dpi compared to an array having 300 dpi. This reduction in bond area can result in weaker electrical interconnects that may fail after stressing due, for example, to thermal cycling, thermal aging, and PZT actuations.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, an ink jet print head can include a piezoelectric element array having a plurality of piezoelectric elements, wherein each piezoelectric element is spaced from adjacent piezoelectric elements by an interstitial space, a plurality of standoff layer supports within the interstitial space, a standoff layer physically attached to the plurality of standoff layer supports, wherein the standoff layer comprises a plurality of openings therein which expose an upper surface of each piezoelectric element, a circuit layer attached to the standoff layer and comprising a plurality of conductive pads attached to the plurality of piezoelectric elements through the plurality of openings, and an ink path through the ink jet print head, wherein the print head is configured such that, during use of the print head, the ink path does not extend through the plurality of standoff layer supports.

In another embodiment of the present teachings, a method for forming an ink jet print head can include removing a portion of a piezoelectric layer to form a plurality of piezoelectric elements, wherein each piezoelectric element is spaced from adjacent piezoelectric elements by an interstitial space, forming a plurality of standoff layer supports within the interstitial space, attaching a standoff layer to the plurality of standoff layer supports, forming a conductor within a plurality of openings within the standoff layer, attaching a circuit layer to the conductor to electrically couple a plurality of pads of the circuit layer with the plurality of piezoelectric elements using the conductor, and forming an ink path through the ink jet print head, wherein the print head is configured such that, during use of the print head, the ink path does not extend through the plurality of standoff layer supports.

In another embodiment of the present teachings, an ink jet printer can include an ink jet printhead having a piezoelectric element array comprising a plurality of piezoelectric elements, wherein each piezoelectric element is spaced from adjacent piezoelectric elements by an interstitial space, a plurality of standoff layer supports within the interstitial space, a standoff layer physically attached to the plurality of standoff layer supports, wherein the standoff layer comprises a plurality of openings therein which expose an upper surface of each piezoelectric element, a circuit layer attached to the standoff layer and comprising a plurality of conductive pads attached to the plurality of piezoelectric elements through the plurality of openings, and an ink path through the ink jet print head, wherein the print head is configured such that, during use of the print head, the ink path does not extend through the plurality of standoff layer supports. The ink jet print head can further include a printer housing which encases at least one ink jet print head.

In another embodiment of the present teachings, an ink jet print head can include a piezoelectric element array comprising a plurality of piezoelectric elements, wherein each piezoelectric element is spaced from adjacent piezoelectric elements by an interstitial space, a plurality of standoff layer supports within the interstiitial space, wherein the plurality of standoff layer supports and the plurality of piezoelectric elements comprise the same physical structure, a standoff layer physically attached to the plurality of standoff layer supports, wherein the standoff layer comprises a plurality of openings therein which expose an upper surface of each piezoelectric element, and a circuit layer attached to the standoff layer and comprising a plurality of conductive pads attached to the plurality of piezoelectric elements through the plurality of openings.

In another embodiment of the present teachings, a method for forming an ink jet print head can include removing a portion of a piezoelectric layer to form a plurality of piezoelectric elements and a plurality of standoff layer supports from the piezoelectric layer, wherein the plurality of standoff layer supports are within an interstitial space between each adjacent piezoelectric element, attaching a standoff layer to the plurality of standoff layer supports, forming a conductor within a plurality of openings through the standoff layer, and attaching a circuit layer to the conductor to electrically couple a plurality of pads of the circuit layer with the plurality of piezoelectric elements using the conductor.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

An embodiment of the present teachings can result in a more robust physical connection between the circuit layer and the PZT array, and may result in decreased stresses on the interconnection which electrically couples the PZT to the circuit layer.

Figure 1:
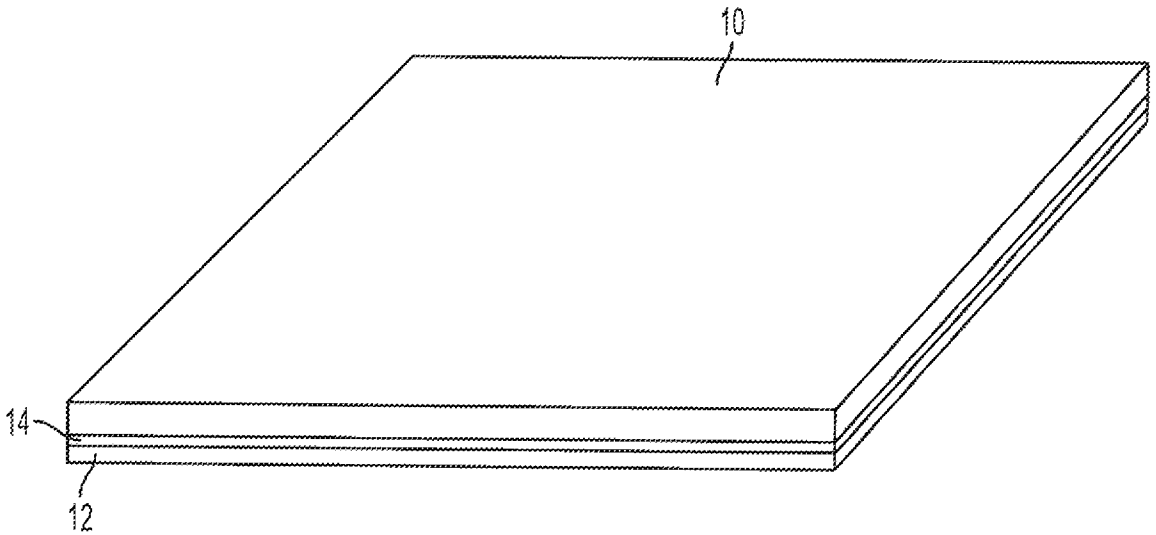
FIGS. 1 and 2 are perspective views depicting the formation of a standoff layer support layer in accordance with an embodiment of the present teachings.

An embodiment of the present teachings can begin with a structure similar to that depicted in the perspective depiction of FIG. 1, which includes a piezoelectric layer 10 that is detachably bonded to a transfer carrier 12 with an adhesive 14. The piezoelectric layer 10 can include, for example, a lead-zirconate-titanate layer, for example between about 25 μm to about 150 μm thick to function as an inner dielectric. The piezoelectric layer 10 can be plated on both sides with nickel, for example, using an electroless plating process to provide conductive elements on each side of the dielectric PZT. The nickel-plated PZT functions essentially as a parallel plate capacitor which develops a difference in voltage potential across the inner PZT material. The carrier 12 can include a metal sheet, a plastic sheet, or another transfer carrier. The adhesive layer 14 which attaches the piezoelectric layer 10 to the transfer carrier 12 can include a dicing tape, thermoplastic, or another adhesive. In another embodiment, the transfer carrier 12 can be a material such as a self-adhesive thermoplastic layer such that a separate adhesive layer 14 is not required.

Figure 2:
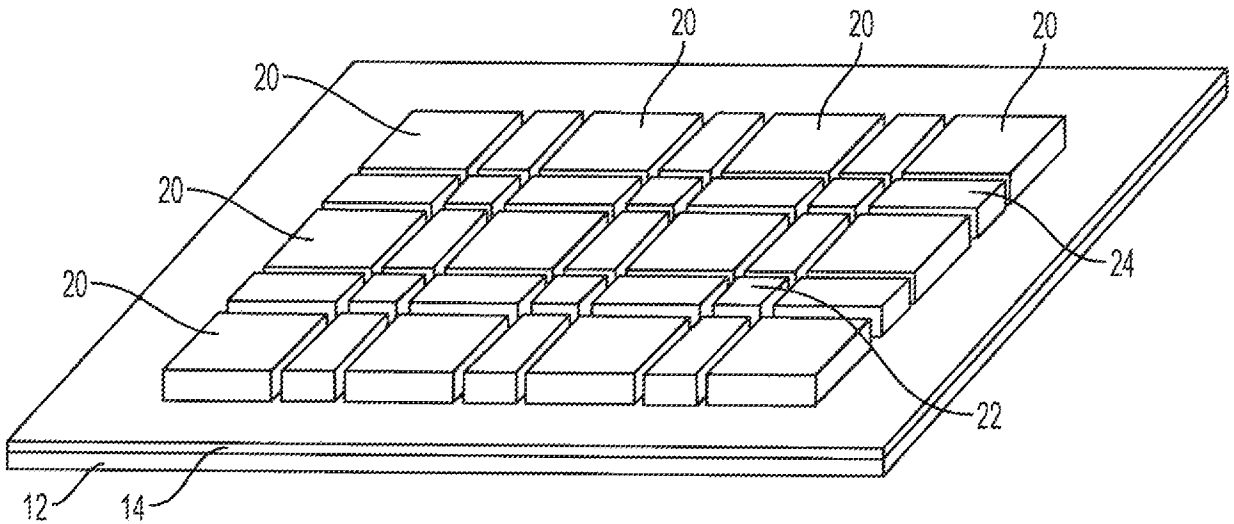

After forming a structure similar to that depicted in FIG. 1, the piezoelectric layer 10 is diced to form a plurality of spaced piezoelectric elements 20 as depicted in FIG. 2. The array can be arranged in a plurality of rows and columns. It will be appreciated that while FIG. 1 depicts 4×3 array of piezoelectric elements 10, a larger array including hundreds or thousands of piezoelectric elements can be formed. For example, print heads may have a 344×20 array of piezoelectric elements 20. The dicing can be performed using mechanical techniques such as through the use of a wafer dicing saw, or by using a dry etching process, using a laser ablation process, etc. In the FIG. 2 structure, exactly two saw kerfs are formed between adjacent piezoelectric elements. To ensure complete separation of each adjacent piezoelectric element 20, the dicing process can terminate after removing a portion of the adhesive 14 and stopping on the transfer carrier 12, or after dicing through the adhesive 14 and into the carrier 12.

The piezoelectric element array including the piezoelectric elements 20 can be electrically coupled to a circuit layer and can be active during use of the print head to eject ink from a plurality of print head nozzles. In this embodiment, the dicing process also forms a plurality of first standoff layer supports 22 and second standoff layer supports 24 from the piezoelectric layer 10 which will not be electrically active during use of the print head. Because the plurality of supports 22, 24 and the plurality of piezoelectric elements are formed from the same layer(s) 10 of FIG. 1, they have the same physical structure (i.e., are formed from the same layer or layers). For example, both can include a layer of lead-zirconate-titanate plated on both sides with nickel. The plurality of first supports 22 and second supports 24 are electrically isolated from each piezoelectric element 20. The first supports 22 are located at the intersection of the array rows and columns, and the second supports 24 are located between two adjacent piezoelectric elements 20 within a single row or column. In an embodiment, each piezoelectric element 20 can be separated by one or more first supports 22 by a distance equal to the width of a dicing saw blade, for example between about 10 μm and about 30 μm, for example about 20 μm. This approach can increase the available bonding area for the standoff layer by more than 120% over a conventional print head, and can result in the formation of a more secure (stronger) attachment of a circuit layer to a jet stack subassembly.

Figure 3:
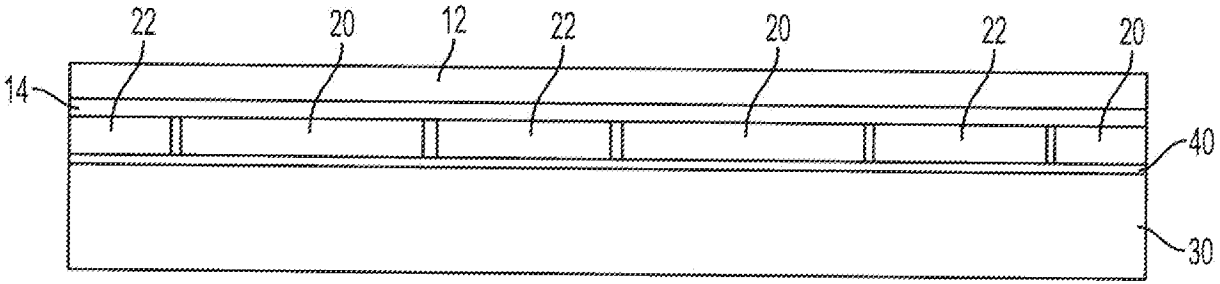
FIGS. 3-7 are cross sections depicting the formation of a print head in accordance with an embodiment of the present teachings.

After forming the individual piezoelectric elements 20 and the supports 22, 24, the FIG. 2 assembly can be attached to a jet stack subassembly 30 as depicted in the cross section of FIG. 3. The FIG. 3 cross section is magnified from the FIG. 2 structure for improved detail, and depicts cross sections of one partial and two complete piezoelectric elements 20, as well as one partial and two complete first supports 22.

The jet stack subassembly 30 can be manufactured using known techniques in any number of jet stack designs, and is depicted in block form for simplicity. In an embodiment, the FIG. 2 structure can be attached to the jet stack subassembly 30 using a continuous adhesive layer 40, or another adhesive structure. After applying the adhesive layer 40, the jet stack subassembly 30 and the piezoelectric elements 20 are aligned with each other, then the piezoelectric elements 20 are mechanically connected to the jet stack subassembly 30 with the adhesive. The adhesive layer 40 is cured by techniques appropriate for the adhesive to result in the FIG. 3 structure.

Figure 4:
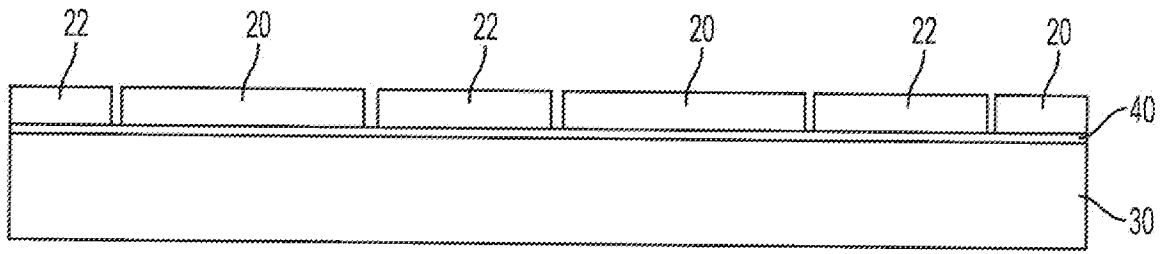
Figure 5:
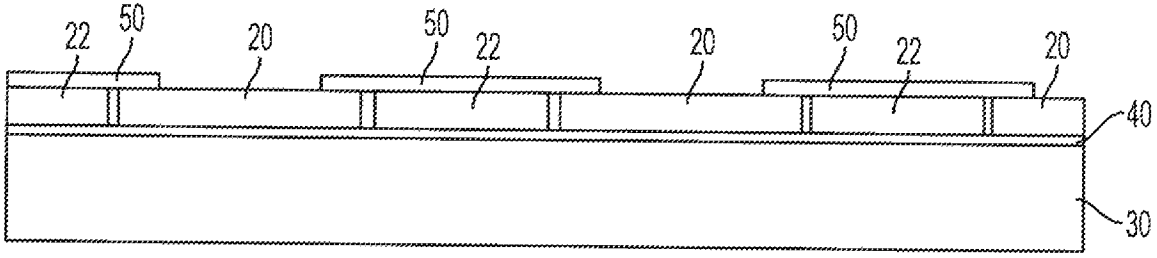

Subsequently, the transfer carrier 12 and the adhesive 14 are removed from the FIG. 3 structure to result in the structure of FIG. 4. Next, a patterned standoff layer 50 can be adhered or applied to upper surfaces of the piezoelectric elements 20 and supports 22, 24 as depicted in FIG. 5. The standoff layer 50 can be, for example, an etched or laser cut polymer and adhesive sheet or a B-stage acrylic thermosetting adhesive. The standoff layer 50 covers an upper surface of each support 22, 24 in its entirety, and includes patterned openings therethrough which expose an upper surface of each piezoelectric element 20.

Figure 6:
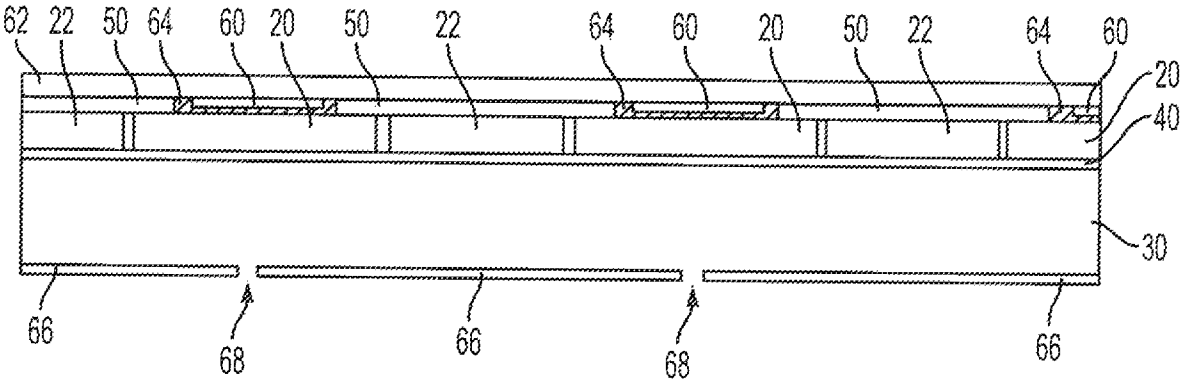

Subsequently, a plurality of conductive pads 60 of a circuit layer 62 can be electrically coupled (connected) to the piezoelectric elements 20 through the openings in the standoff layer 50 as depicted in FIG. 6. In an embodiment, a conductor 64 such as a conductive paste or solder can be applied to an upper surface of each piezoelectric element 20, the conductive pads 60 of the circuit layer 62 are aligned with the plurality of piezoelectric elements 20, and the plurality of conductive pads 60 are placed into the conductor 64 to provide an electrical interconnect which electrically couples each conductive pad 60 to one of the piezoelectric elements 20 as depicted in FIG. 6. Additional processing, such as the attachment of a nozzle plate 66 having a plurality of apertures or nozzle openings 68 therein, can be performed to fabricate a complete ink jet print head. The apertures 68 form a terminal end of an ink path which extends through the ink jet print head.

While the supports 22, 24 provide no electrical functionality in this embodiment, they provide an increased surface area for the attachment of the standoff layer 50. Without supports 22, 24, the standoff layer would bridge the openings between adjacent piezoelectric elements 20 and would remain unsupported. Devices with large piezoelectric elements 20 have sufficient surface area for the attachment of a standoff layer. However, with decreasing piezoelectric element sizes in print heads having increased resolution, the area of the piezoelectric elements used for attachment of the standoff layer 50 must be balanced with the area used for the subsequent attachment of the circuit layer 62. Using a larger piezoelectric element area for connection of the standoff layer decreases the connection area for the conductor 64, and stresses during actuation of the piezoelectric elements and thermal expansion and contraction have a greater effect on the connection and can decrease reliability of the connection between the pads 60 and the piezoelectric elements 20. The supports 22, 24 provide a large surface area for connection of the standoff 50 so that larger openings within the standoff layer 50 can be used.

Figure 7:
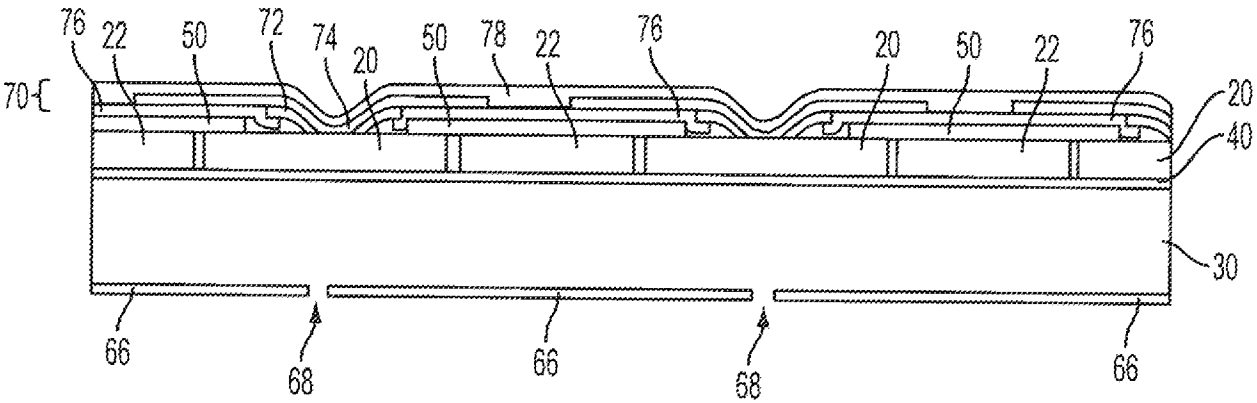

In an alternate embodiment, a separate conductor such as conductor 64 is not used, but electrical connection between each piezoelectric element 20 and an embossed circuit layer 70 such at that depicted in FIG. 7 is established through asperity contact. Asperity contact is described, for example, in U.S. patent application Ser. No. 13/097,182, which is incorporated herein by reference in its entirety. The circuit layer 70 of FIG. 7 can include an array of pads 72 which are continuous with a plurality of traces 74 interposed between a first dielectric layer 76 and a second dielectric layer 78. Each pad 72 includes a plurality of conductive asperities (not individually depicted for simplicity) which physically and electrically contact with asperities (not individually depicted for simplicity) on the upper surface of the piezoelectric elements 20. The increased surface area provided by supports 22, 24 can help insure that asperity contact is maintained between the pads 72 and the piezoelectric elements 20.

In both cases depicted in FIGS. 6 and 7, the multi-point electrical interconnect provided by conductor 64 or the asperities is held in place by physically bonding the circuit layer 62, 70 to the piezoelectric element array 20 with the standoff layer 50, and the conductor 64, 72 extends through the opening in the standoff layer 50. In conventional embodiments which do not include supports 22, 24 directly between adjacent piezoelectric elements 20 in the interstitial space, the effective bonding area is limited due to the empty and unsupported interstitial region between piezoelectric elements 20. Because a standoff adhesive 50 such as a B-stage acrylic thermosetting adhesive has bonding requirements involving both heat and pressure, the effective bonding area is confined to regions that contain supporting material beneath it (i.e., only the piezoelectric element array in conventional designs). Fabrication and use of supports 22, 24 increases this effective bonding area to provide an improved bond between the circuit layer 62, 70 and the piezoelectric elements 20. In either of these embodiments where the supports 22, 24 have the same physical structure as the piezoelectric elements 24, the ink path which extends through the ink jet print head and can terminate at the apertures 68 in the aperture plate 66 may or may not be farmed through one or more supports 22, 24 in accordance with known techniques.

Figure 8:
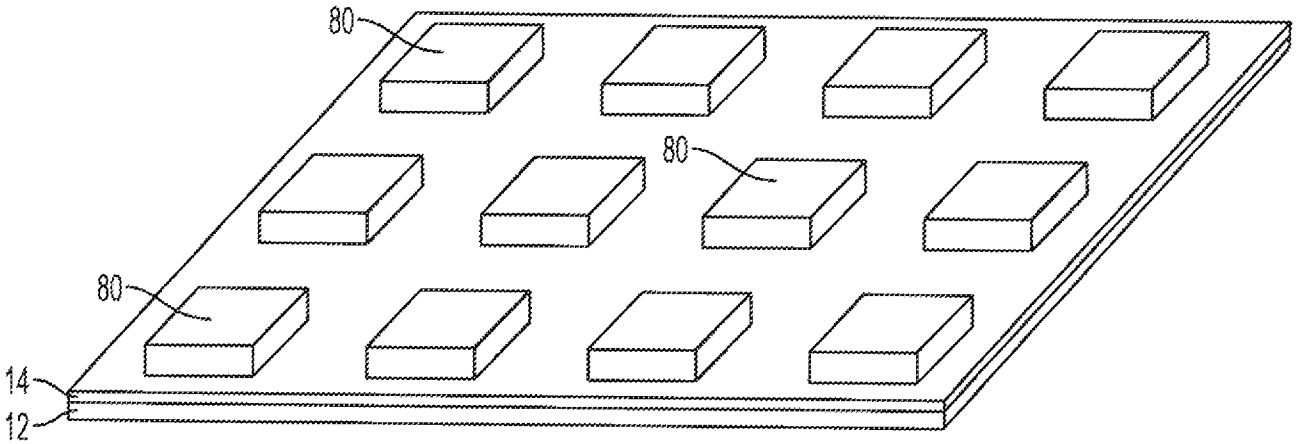
FIGS. 8 and 9 are perspective views depicting the formation of a standoff layer support layer in accordance with an embodiment of the present teachings.
Figure 9:
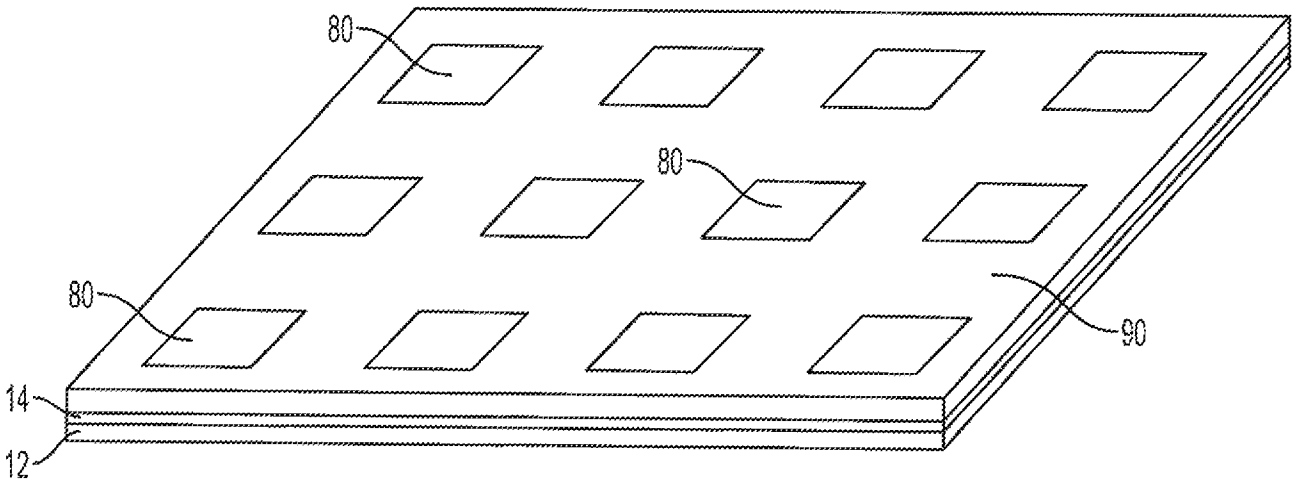

In another embodiment, a blanket piezoelectric layer 10 can be attached to a transfer carrier 12 with an adhesive 14 as depicted in FIG. 1, and then patterned to form a piezoelectric element array including a plurality of piezoelectric elements 80 as depicted in FIG. 8. In contrast the embodiments of the present teachings described above, supports 22, 24 are not formed from piezoelectric material 10 but all the piezoelectric material 10 is removed from between the piezoelectric elements 80. After forming a structure similar to that depicted in FIG. 8, a dielectric layer 90 such as a polymer layer as depicted in FIG. 9 can be dispensed over the piezoelectric array and within the interstitial space directly between each piezoelectric element 80, cured, and planarized or otherwise removed from the upper surface of each piezoelectric array to expose the upper surface. An upper surface of the dielectric layer 90 can be targeted to be co-planar with the upper surface of the piezoelectric elements 80.

Figure 10:
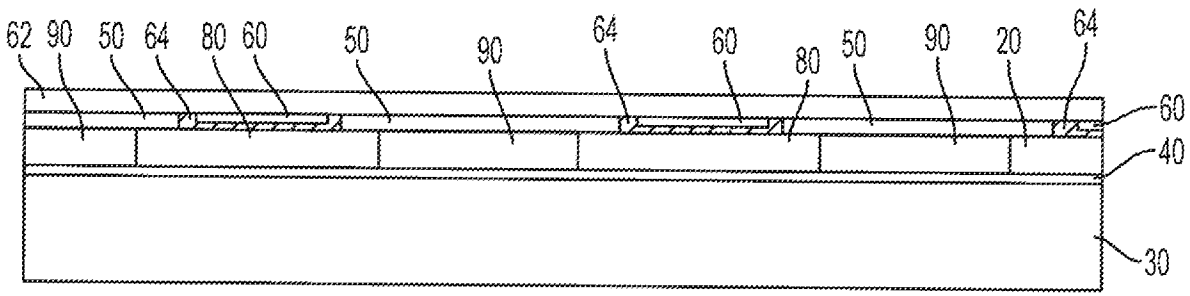
FIG. 10 is a cross section depicting the formation of a print head in accordance with an embodiment of the present teachings.

Subsequently, the piezoelectric element array and dielectric layer 90 can be attached to a jet stack subassembly 30 as depicted in the cross section of FIG. 10. In an alternate embodiment, the dielectric layer 90 can be omitted from the FIG. 9 structure and formed after attaching the piezoelectric elements 80 to the jet stack subassembly by dispensing a dielectric material over the jet stack subassembly 30. In this alternate embodiment, a dielectric layer such as a polymer can be dispensed over the piezoelectric array and the jet stack subassembly and within the interstitial space between adjacent piezoelectric elements 80, cured, and planarized or otherwise removed to expose the upper surface of each piezoelectric array.

Next, processing can continue according the embodiments of the present teachings discussed above. For example, a patterned standoff layer 50 can be formed on the surface of the dielectric layer 90 and along an edge of each piezoelectric element 80. Conductive pads 60 of a circuit layer 62 such as a flex circuit or PCB can be electrically coupled to the plurality of piezoelectric elements 80 using a conductor 64 such as a conductive paste or a solder material. In another embodiment, an embossed circuit layer 70 may be used. Processing may continue to form a completed print head.

The dielectric layer provides a plurality of supports 90 in an interstitial space between adjacent piezoelectric elements 80 a greater surface area for the attachment of the standoff layer 90. While the dielectric which fills the interstitial regions appears in cross section as separate supports and is described herein as a plurality of supports, each support in at least part of the array can be provided by a continuous dielectric layer as depicted in FIG. 9. The plurality of supports 90 provide similar benefits as the supports 22, 24 described above. In this embodiment, the supports physically contact the plurality of dielectric layer which forms the plurality of supports Polymer interstitial layers have been previously provided between piezoelectric elements. For example, U.S. patent Ser. No. 13/165,785, commonly assigned herewith and incorporated by reference herein by reference in its entirety, describes an dielectric interstitial layer. However, prior dielectric interstitial layers have been provided so that ink ports can be etched through the interstitial layer between adjacent piezoelectric elements to provide a fluid path for the ink in the print head. In prior designs, no interstitial layer has been formed if no ink ports are located between adjacent piezoelectric elements. In the embodiment of FIG. 10, the print head design is such that, during use of the print head, no ink path within the print head is located through the plurality of supports 90 between adjacent piezoelectric elements 80. In this print head design, the ink ports are located at another print head location, but the dielectric supports 90 provide an attachment point for the standoff layer 50. Because there is no ink port formed through supports 90, the requirements for the dielectric layer 90 are different. For example, forming an ink port through each dielectric support in the interstitial space between adjacent piezoelectric elements 80 requires a very planar and bubble-free material to prevent ink leaks during use and printing using the print head. With the FIG. 10 embodiment, the supports 90 do not provide part of the ink path during use of the print head. Accordingly, elimination of o-bubbles within the material is not required, and prior additional processing techniques which were performed to remove the bubbles before curing the material can be omitted.

Figure 11:
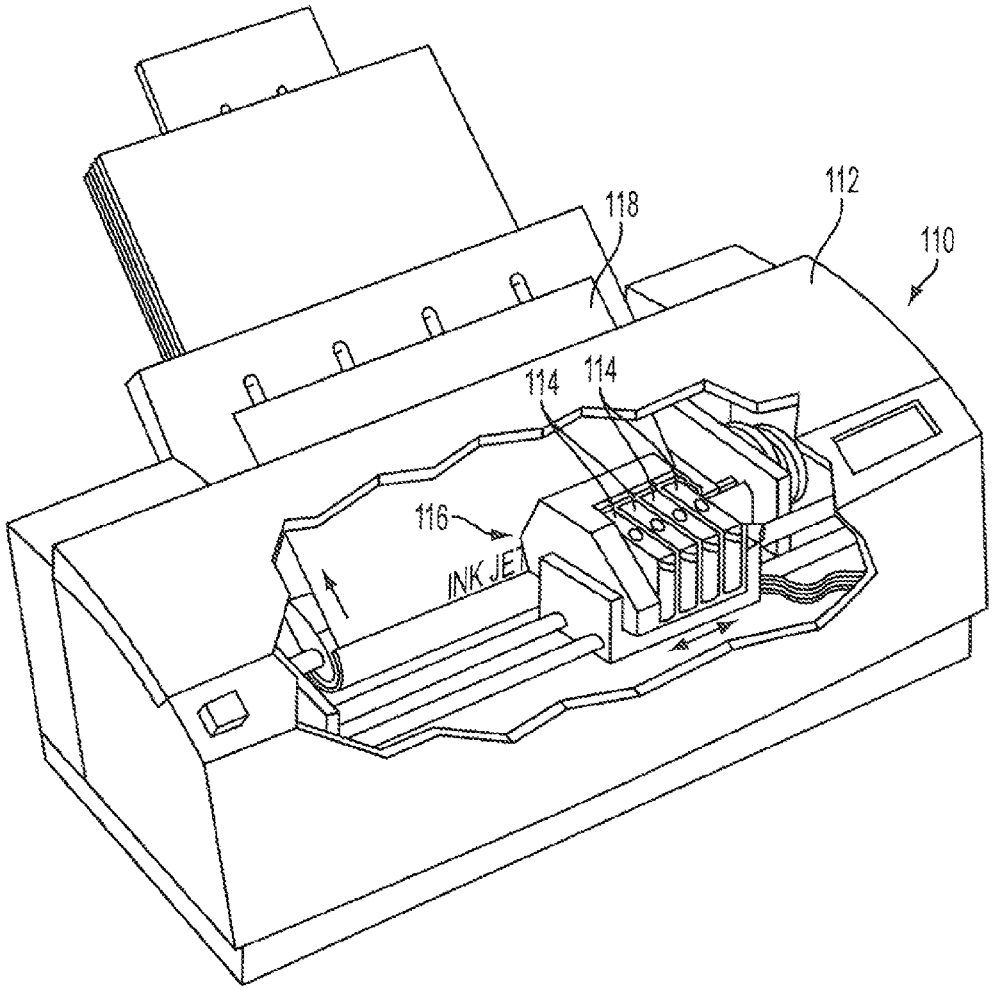
FIG. 11 is a perspective view of a printer which can be formed using an embodiment of the present teachings.

After completing the print head, one or more print heads according to an embodiment of the present teachings can be installed into a print device. FIG. 11 depicts a printer 110 including a printer housing 112 which encases at least one print head 114 including a plurality of supports in accordance with the present teachings as discussed above. During operation of the printer 110, ink 116 is ejected from the one or more print heads 114. Each print head 114 is operated in accordance with digital instructions to create a desired ink image 116 on a print medium 118 such as a paper sheet, plastic, etc. Each print head 114 may move back and forth relative to the print medium 118 in a scanning motion to generate the printed image swath by swath. Alternately, each print head 114 may be held fixed and the print medium 118 moved relative to it, creating an image as wide as the print head 114 in a single pass. Each print head 114 can be narrower than, or as wide as, the print medium 118. In another embodiment, each print head 114 can print to an intermediate surface such as a rotating drum or belt (not depicted for simplicity) for subsequent transfer to a print medium.

Thus an embodiment of the present teachings can include a plurality of material supports within the interstitial space between individual PZTs to increase the effective bond area of a standoff layer and to provide a more reliable electrical interconnect. In an embodiment, dice and transfer process for a piezoelectric layer leaves electrically nonfunctional piezoelectric material between the electrically functional PZT actuators. This process can be performed with one pass of a dicing blade on each side of the piezoelectric element (two total passes between adjacent piezoelectric elements) to electrically isolate each support from the piezoelectric elements. Using kerf widths of 20 um, this approach can increase bond area more than 120%. In another embodiment, a polymer-based interstitial material functions as the plurality of supports. Because this polymer fills the entire interstitial space between adjacent piezoelectric elements, this approach can increase bond area by more than 170% in some print head designs, depending on the size and pitch of the piezoelectric elements.

Increasing effective, bond area can be highly desirable for ensuring a stronger bond between the PZT array and the flexible printed circuit. This enables an electrical interconnect that's more resistant to open connections and missing jets. This capability will be important as print head resolutions increase and future designs entertain more frequent power cycles.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that, is, any and all sub-ranges having a minimum value of equal to or greater than zero and a maximum value of equal to or less than 10, e.g. 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening, materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower", "over," "top," and "under" are defined with respect to the conventional plane or working surface being on the top surface of the workpiece, regardless of the orientation of the workpiece.

The invention claimed is:

1. An ink jet print head, comprising:

a piezoelectric element array comprising a plurality of piezoelectric elements, wherein each piezoelectric element is spaced from adjacent piezoelectric elements by an interstitial space;

a plurality of standoff layer supports within the interstitial space;

a standoff layer physically attached to the plurality of standoff layer supports, wherein the standoff layer comprises a plurality of openings therein which expose an upper surface of each piezoelectric element;

a circuit layer attached to the standoff layer and comprising a plurality of conductive pads attached to the plurality of piezoelectric elements through the plurality of openings; and an ink path through the ink jet print head, wherein the print head is configured such that, during use of the print head, the ink path does not extend through the plurality of standoff layer supports, wherein the plurality of standoff layer supports and the plurality of piezoelectric elements are made of a same material, and wherein each standoff layer support is separated from an adjacent piezoelectric element by a distance equal to the width of a dicing saw blade.

2. The print head of claim 1, wherein the plurality of standoff layer supports and the plurality of piezoelectric elements comprise a same physical structure.

3. The print head of claim 1, wherein the plurality of standoff layer supports and the plurality of piezoelectric elements comprise a layer of lead-zirconate-titanate plated on a top side and a bottom side with nickel.

4. The print head of claim 1, further comprising exactly two saw kerfs between adjacent piezoelectric elements.

5. The print head of claim 1, wherein the plurality of standoff layer supports comprise a polymer.

6. The print head of claim 1, further comprising a conductor which extends through the plurality of openings in the standoff layer and electrically couples each conductive pad to one of the plurality of piezoelectric elements.

7. An ink jet printer, comprising:

an ink jet printhead, comprising:

a piezoelectric element array comprising a plurality of piezoelectric elements, wherein each piezoelectric element is spaced from adjacent piezoelectric elements by an interstitial space;

a plurality of standoff layer supports within the interstitial space;

a standoff layer physically attached to the plurality of standoff layer supports, wherein the standoff layer comprises a plurality of openings therein which expose an upper surface of each piezoelectric element;

a circuit layer attached to the standoff layer and comprising a plurality of conductive pads attached to the plurality of piezoelectric elements through the plurality of openings; and an ink path through the ink jet print head, wherein the print head is configured such that, during use of the print head, the ink path does not extend through the plurality of standoff layer supports, wherein the plurality of standoff layer supports and the plurality of piezoelectric elements are made of a same material, and wherein each standoff layer support is separated from an adjacent piezoelectric element by a distance equal to the width of a dicing saw blade; and a printer housing which encases at least one ink jet print head.

8. The ink jet printer of claim 7, wherein the plurality of standoff layer supports and the plurality of piezoelectric elements comprise a same physical structure.

9. The ink jet printer of claim 7, wherein the plurality of standoff layer supports and the plurality of piezoelectric elements comprise a layer of lead-zirconate-titanate plated on, a top side and a bottom side with nickel.

10. The ink jet printer of claim 7, further comprising exactly two saw kerfs between adjacent piezoelectric elements.

11. The ink jet printer of claim 7, wherein the plurality of standoff layer supports comprise a polymer.

12. The ink jet printer of claim 7, further comprising a conductor which extends through the plurality of openings in the standoff layer and electrically couples each conductive pad to one of the plurality of piezoelectric elements.

13. An ink jet print head, comprising:

a piezoelectric element array comprising a plurality of piezoelectric elements, wherein each piezoelectric element is spaced from adjacent piezoelectric elements by an interstitial space;

a plurality of standoff layer supports within the interstitial space, wherein the plurality of standoff layer supports and the plurality of piezoelectric elements comprise a same physical structure;

a standoff layer physically attached to the plurality of standoff layer supports, wherein the standoff layer comprises a plurality of openings therein which expose an upper surface of each piezoelectric element;

a circuit layer attached to the standoff layer and comprising a plurality of conductive pads attached to the plurality of piezoelectric elements through the plurality of openings, wherein the plurality of standoff layer supports and the plurality of piezoelectric elements are made of a same material, and wherein each standoff layer support is separated from an adjacent piezoelectric element by a distance equal to the width of a dicing saw blade.

14. The ink jet print head of claim 13, wherein each piezoelectric element and each standoff layer support comprises a layer of lead-zirconate-titanate plated on a top side and a bottom side with nickel.

* * * * *